US010092120B1

(12) United States Patent
Yoder

(10) Patent No.: US 10,092,120 B1
(45) Date of Patent: Oct. 9, 2018

(54) STABILIZING APPARATUS FOR BOTTLES OR OTHER FLUID STORING CONTAINERS

(71) Applicant: Scott Johnathan Yoder, Modesto, CA (US)

(72) Inventor: Scott Johnathan Yoder, Modesto, CA (US)

( * ) Notice: Subject to any disclaimer, the term of this patent is extended or adjusted under 35 U.S.C. 154(b) by 0 days.

(21) Appl. No.: 15/591,844

(22) Filed: May 10, 2017

(51) Int. Cl.
*A47G 23/03* (2006.01)

(52) U.S. Cl.
CPC ..... *A47G 23/03* (2013.01)

(58) Field of Classification Search
CPC ..... A47G 23/03; A47G 23/0316; A47G 23/0241; B65D 25/22; B65D 25/24; B65D 90/14; B65D 90/12; B65D 88/128; B65D 88/129
USPC ..... 215/395, 386; 220/630, 631, 628, 737, 220/629, 634, 649, 648, 647; 248/148, 248/146, 127, 143, 133, 128
See application file for complete search history.

(56) References Cited

U.S. PATENT DOCUMENTS 558,433 A * 4/1896 Stoddard ..... A47F 5/112 211/73
2,784,577 A * 3/1957 Beaham ..... A47G 23/0216 215/393
3,606,074 A * 9/1971 Hayes ..... B65D 25/24 215/228
4,760,987 A 8/1988 Lan
4,907,712 A * 3/1990 Stempin ..... F17C 13/084 220/630
5,344,034 A * 9/1994 Eagan ..... A61J 9/00 215/11.1
5,447,764 A 9/1995 Langford
6,105,799 A * 8/2000 Takagawa ..... A47J 41/026 215/12.1
8,087,528 B1 * 1/2012 Scarlett ..... A47G 23/0216 220/23.89
D658,267 S * 4/2012 Brockington ..... D23/206
2006/0278769 A1 * 12/2006 Pineda ..... A47G 7/025 248/104
2007/0228243 A1 10/2007 Phillips
2014/0231439 A1 * 8/2014 Manser ..... F16M 11/04 220/581
2017/0027358 A1 * 2/2017 Weissbart ..... A47G 23/03

* cited by examiner

*Primary Examiner* — Robert J Hicks
(74) *Attorney, Agent, or Firm* — Plager Schack LLP

(57) ABSTRACT

A stabilizing apparatus coupled to a bottle and designed to prevent the bottle from tipping over when disposed on a flat surface is provided. The stabilizing apparatus includes a ring having a top surface, a bottom surface opposite the top surface and an outer side beveled surface connecting the top and bottom surfaces together. The ring includes a central opening disposed therethrough to receive the bottle. The central opening has an upper slanted inner surface having a plurality of ridges that contact the bottle. Spacing between the plurality of ridges in the upper slanted inner surface reduce a surface area of the upper slanted inner surface in contact with the bottle, thereby permitting slidable adjustments of the ring relative to the bottle with enhanced efficiency.

6 Claims, 4 Drawing Sheets

FIG.3
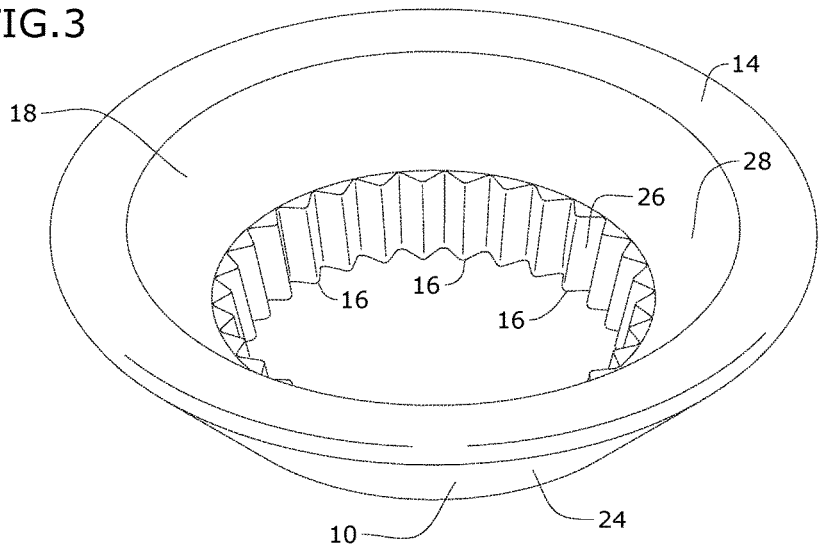
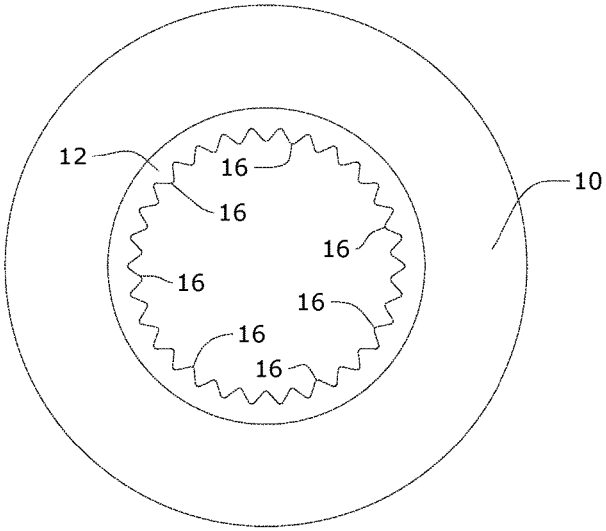
FIG.4

STABILIZING APPARATUS FOR BOTTLES OR OTHER FLUID STORING CONTAINERS

BACKGROUND

The embodiments herein relate generally to devices for supporting fluid storing containers such as bottles.

Fluid storing containers such as cups, cans, bottles or other containers are used to store beverages for human consumption. These beverages may include beer, soda, milk, juice, tea, and the like. These fluid containers are often placed on a flat surface such as a table. In most bottles, each container comprises a narrow head portion connected to a lower base cylindrical portion. These bottles when placed on a table are often inadvertently knocked over by an individual's hand, arm, or other body part in motion. Although the base of each bottle is wider than the head portion, the bottle is still relatively unstable and easy to knock over.

Several beverage stabilizing devices exist as disclosed in U.S. Patent Application Publication 2007/0228243, U.S. Pat. Nos. 5,447,764, 4,919,284 and 4,760,987. Each of these devices comprises a base member attached to a beverage container. However, these beverage stabilizing devices are limited because they are not easily attached to or removed from the beverage container or they comprise a plurality of bulky and/or complicated components.

As such, there is a need in the industry for a bottle stabilizing apparatus that addresses the limitations of the prior art, which prevents a bottle or other beverage container from tipping over when placed on a flat surface such as a table. There is a further need for the bottle stabilizing apparatus to be easily attached to or removed from the bottle or beverage container.

SUMMARY

A stabilizing apparatus coupled to a bottle and configured to prevent the bottle from tipping over when disposed on a flat surface is provided. The stabilizing apparatus comprises a ring comprising a top surface, a bottom surface opposite the top surface and an outer side beveled surface connecting the top and bottom surfaces together, the ring comprising a central opening disposed therethrough to receive the bottle, the central opening comprising an upper slanted inner surface comprising a plurality of ridges configured to contact the bottle, wherein spacing between the plurality of ridges in the upper slanted inner surface reduce a surface area of the upper slanted inner surface in contact with the bottle, thereby permitting slidable adjustments of the ring relative to the bottle with enhanced efficiency.

BRIEF DESCRIPTION OF THE FIGURES

The detailed description of some embodiments of the invention will be made below with reference to the accompanying figures, wherein the figures disclose one or more embodiments of the present invention.

FIG. 3 depicts a bottom perspective view of certain embodiments of the bottle stabilizing apparatus;

FIG. 4 depicts a top view of certain embodiments of the bottle stabilizing apparatus;

DETAILED DESCRIPTION OF CERTAIN EMBODIMENTS

Figure 1:
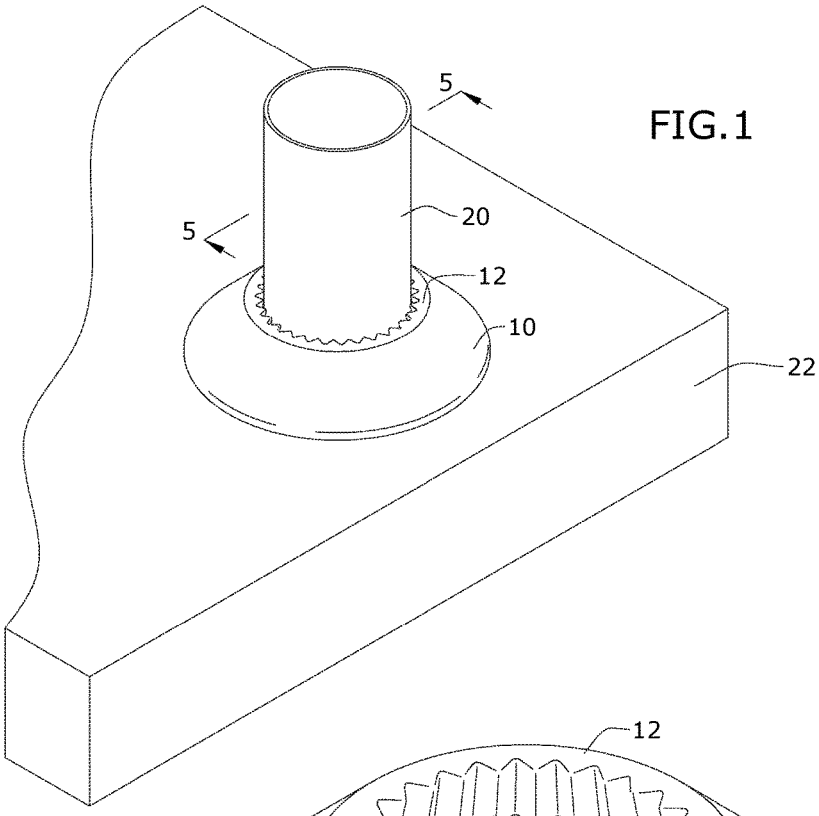
FIG. 1 depicts a perspective view of certain embodiments of the bottle stabilizing apparatus shown in use.
Figure 2:
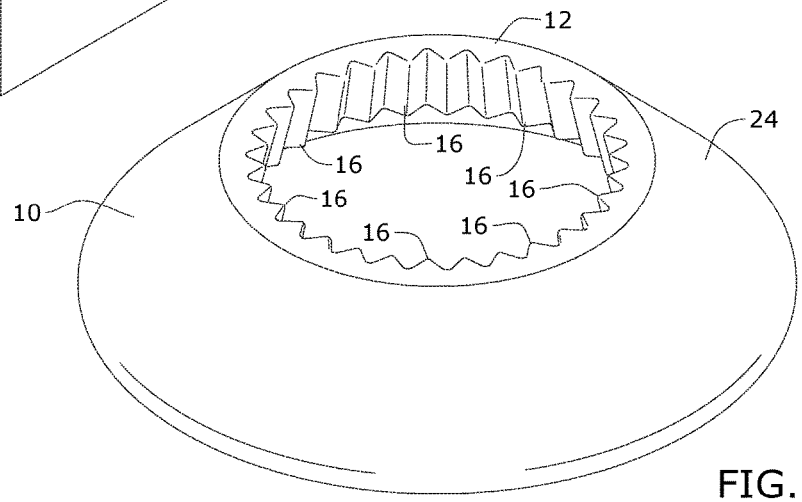
FIG. 2 depicts a top perspective view of certain embodiments of the bottle stabilizing apparatus.

As depicted in FIG. 1, the stabilizing apparatus comprises ring 10 configured to be disposed around container 20. The stabilizing apparatus prevents container 20 from tipping or knocking over when ring 10 and container 20 are disposed on a flat surface such as table 22. Container 20 may be any fluid storing container including, but not limited to, a cup, bottle, jar, glass, or the like. As depicted in FIGS. 2-6, ring 10 generally comprises top surface 12, bottom surface 14, inner slanted surface 18 and outer beveled surface 24. In a preferred embodiment, ring 10 is made from flexible, compressible and resilient food-grade silicone. However, alternative materials known in the field may be used instead.

Inner slanted surface 18 of ring 10 comprises upper slanted inner surface 26 and lower slanted inner surface 28 that form a central opening configured to receive container 20. A plurality of ridges 16 are evenly disposed throughout upper slanted inner surface 26 and oriented generally parallel to each other. In one embodiment, upper slanted inner surface 26 extends at a steeper angle than lower slanted inner surface 28 relative to a horizontal plane. As a result, container 20 disposed through the central opening of ring 10 only contacts portions of ridges 16 in upper slanted inner surface 26 as depicted in FIGS. 5-6.

In a preferred embodiment, outer beveled surface 24 and lower slanted inner surface 28 are oriented generally parallel to each other. Outer beveled surface 24 forms an angle A with a horizontal plane wherein A is equal to approximately 45 degrees. In a preferred embodiment, the height of ring 10 is approximately 1", the diameter of bottom surface 14 is approximately 4.5", and the distance between opposing ridges 16 across the opening proximate top surface 12 is approximately 2.157".

In operation, container 20 is inserted through the central opening of ring 10 as depicted in FIG. 1. Ring 10 of the stabilizing apparatus can easily slide around container 20 up and down to the desired position. Container 20 only contacts ridges 16 of upper slanted inner surface 26. Spacing between the plurality of ridges 16 reduce the surface area of upper slanted inner surface 26 in contact with container 20. This reduces friction when sliding ring 10 around container 20, which allows the user to attach or detach the stabilizing apparatus from container 20 with greater efficiency and reduced user effort.

Figure 5:
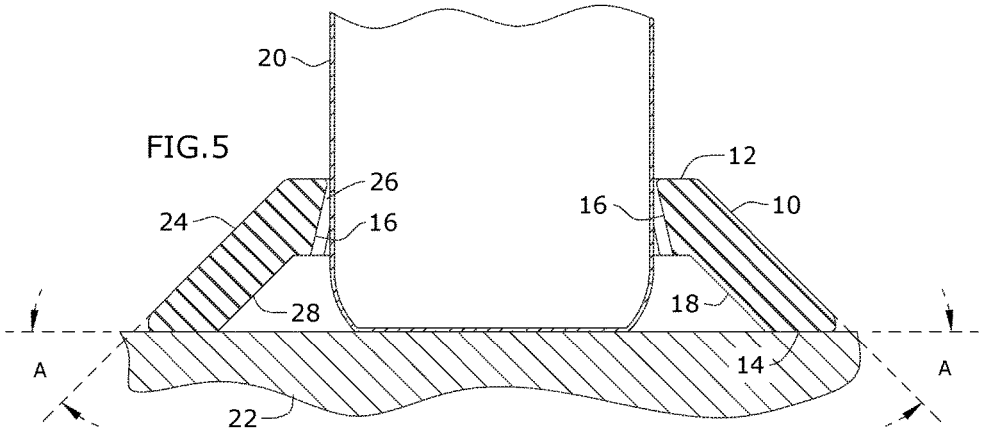
FIG. 5 depicts a section view of certain embodiments of the bottle stabilizing apparatus taken along line 5-5 in FIG. 1.
Figure 6:
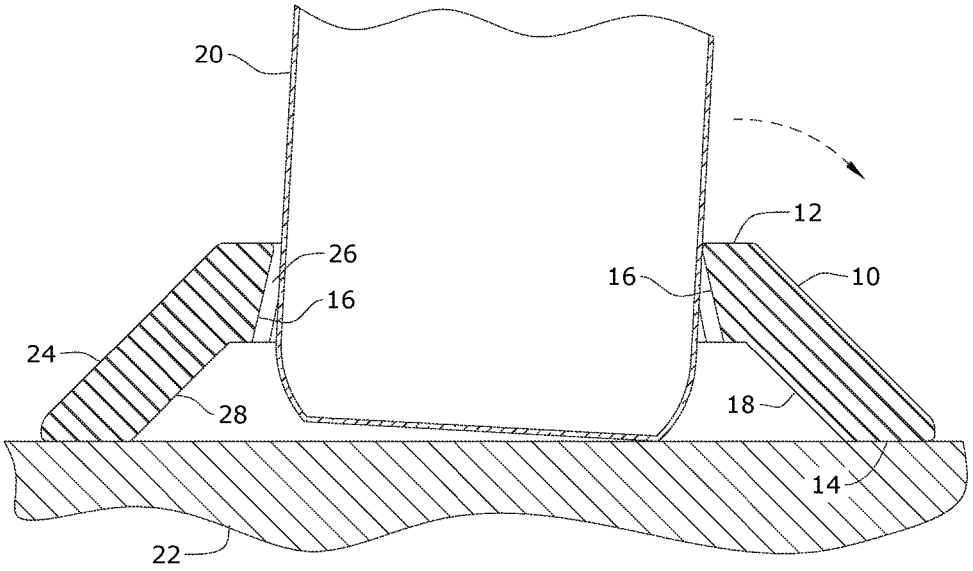
FIG. 6 depicts a section view of certain embodiments of the bottle stabilizing apparatus in use.
Figure 7:
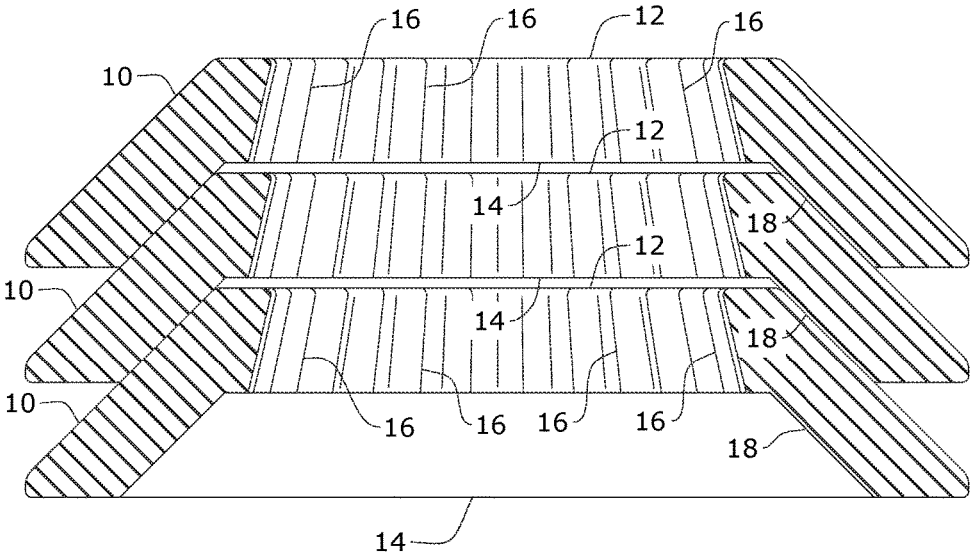
FIG. 7 depicts a section view of certain embodiments of the bottle stabilizing apparatus in a stacked storage configuration.

As depicted in FIGS. 1 and 5-6, ring 10 is adjusted to the bottom of container 20 and disposed on table 22. Bottom surface 14 of ring 10 and container 20 both contact the top of table 22. If container 20 tilts, the side wall contacts a portion of any number of ridges 16 of ring 10 as depicted in FIG. 6. This contact prevents container 20 from completely tipping over and allows the bottom of container 20 to contact table 22 again. When no longer in use, ring 10 is detached from container 20. The shape of the stabilizing apparatus permits multiple rings 10 to be stacked for storage as depicted in FIG. 7.

It shall be appreciated that the spacing between upper and lower slanted inner surfaces 26, 28 and container 20 minimize suction forces that cause ring 10 to stick to table 22 when container 20 is pulled away from the table. As a result, ring 10 remains attached to container 20 when the container is removed from table 22. It shall be appreciated that spacing between ridges 16 permit ring 10 to be more flexible. This allows upper slanted inner surface 26 to stretch. In certain embodiments, upper slanted inner surface 26 and ring 10 are configured to stretch to accommodate a container that is up to approximately 4.5" in diameter.

It shall be appreciated that the components of the stabilizing apparatus described in several embodiments herein may comprise any alternative known materials in the field and be of any color, size and/or dimensions. It shall be appreciated that the components of the stabilizing apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A stabilizing apparatus coupled to a bottle and configured to prevent the bottle from tipping over when disposed on a flat surface, the stabilizing apparatus comprising:

a ring comprising a top surface, a bottom surface opposite the top surface and an outer side beveled surface connecting the top and bottom surfaces together, the ring comprising a central opening disposed therethrough to receive the bottle, the central opening comprising an upper slanted inner surface continuously connected to a lower slanted inner surface, the upper slanted inner surface comprising a plurality of ridges configured to contact the bottle, the upper slanted inner surface extending away from the bottle from the top surface of the ring to an intermediate portion of the ring, the lower slanted inner surface extending away from the bottle from the intermediate portion of the ring to the bottom surface of the ring;

wherein spacing between the plurality of ridges in the upper slanted inner surface reduce a surface area of the upper slanted inner surface in contact with the bottle, thereby permitting slidable adjustments of the ring relative to the bottle with enhanced efficiency.

2. The stabilizing apparatus of claim 1, wherein the plurality of ridges are evenly disposed throughout the upper slanted inner surface and oriented generally parallel to each other.

3. The stabilizing apparatus of claim 2, wherein the central opening of the ring comprises the lower slanted inner surface generally parallel to the outer side beveled surface of the ring.

4. The stabilizing apparatus of claim 3, wherein the lower slanted inner surface of the central opening forms a first angle relative to a horizontal plane and the upper slanted inner surface of the central opening forms a second angle relative to the horizontal plane, wherein the first and second angles are not equal.

5. The stabilizing apparatus of claim 4, wherein the outer side beveled surface of the ring forms an angle with the horizontal plane of approximately 45 degrees.

6. A stabilizing apparatus coupled to a bottle and configured to prevent the bottle from tipping over when disposed on a flat surface, the stabilizing apparatus comprising:

a ring comprising a top surface, a bottom surface opposite the top surface and an outer side beveled surface connecting the top and bottom surfaces together, the ring comprising a central opening disposed therethrough to receive the bottle, the central opening comprising an upper slanted inner surface continuously connected to a lower slanted inner surface, the upper slanted inner surface comprising a plurality of ridges configured to contact the bottle, the upper slanted inner surface extending away from the bottle from the top surface of the ring to an intermediate portion of the ring, the lower slanted inner surface extending away from the bottle from the intermediate portion of the ring to the bottom surface of the ring;

wherein the lower slanted inner surface of the central opening forms a first angle relative to a horizontal plane and the upper slanted inner surface of the central opening forms a second angle relative to the horizontal plane, wherein the first angle is less than the second angle;

wherein spacing between the plurality of ridges in the upper slanted inner surface reduce a surface area of the upper slanted inner surface in contact with the bottle, thereby permitting slidable adjustments of the ring relative to the bottle with enhanced efficiency.

* * * * *